US006045100A

United States Patent [19]

Shields

[11] Patent Number: 6,045,100

[45] Date of Patent: Apr. 4, 2000

[54] SNOWBOARD HOLDER

[76] Inventor: Peter Shields, P.O. Box 91, Mammoth Lakes, Calif. 93546

[21] Appl. No.: 09/032,289

[22] Filed: Feb. 27, 1998

[51] Int. Cl.[7] ..... F21L 15/08

[52] U.S. Cl. ..... 248/222.51; 248/220.21; 248/221.11; 248/222.11; 248/288.11; 248/288.31; 211/85.7; 211/89.01

[58] Field of Search ..... 248/222.51, 220.21, 248/222.11, 221.11, 288.11, 201, 288.31, 316.7, 205; 211/85.7, 89.01

[56] References Cited

U.S. PATENT DOCUMENTS

| | | | |
|---|---|---|---|
| 588,974 | 8/1897 | Frost et al. | 248/316.7 |
| 777,996 | 12/1904 | Applegate | 248/288.31 |
| 2,127,230 | 8/1938 | Moineau | 248/222.11 |
| 2,558,328 | 6/1951 | Winslow | 248/205 |
| 2,775,919 | 1/1957 | Fischer | 248/220.21 |
| 5,645,256 | 7/1997 | Thomas, II | 248/222.11 |
| 5,651,522 | 7/1997 | Davis | 248/221.11 |

*Primary Examiner*—Anita M. King
*Assistant Examiner*—Debbie Short
*Attorney, Agent, or Firm*—Lyon & Lyon LLP

[57] ABSTRACT

A device adapted to be mounted on a supporting wall for holding a snowboard in a substantially vertical disposition with an end of the board resting on the floor or ground. The device includes a base member and a clip member. The clip member defines a pair of snowboard gripping arms and is pivotally mounted on the base member for movement about a horizontal axis whereby the gripping arms can be moved between a snowboard holding position wherein they project outwardly from the base member and a folding position wherein the arms are disposed parallel to and adjacent the base member. In the extended holding position, the clip member can be pivoted about a vertical axis such that upon inserting a transverse portion of the snowboard between the gripping arms, the arms and the snowboard can be moved between perpendicular and parallel orientations with respect to the supporting wall to facilitate access to the snowboard and create an efficient storage means for snowboards.

12 Claims, 3 Drawing Sheets

SNOWBOARD HOLDER

BACKGROUND OF THE INVENTION

The present invention relates to a device for holding snowboards adjacent a wall or other support surface. More particularly, the invention relates to a snowboard holding device which is adapted to be secured to a wall, rail or other support surface and hold the snowboard against the support surface in a substantially vertical disposition with the tip or tail of the board resting on the floor or ground. The holding device of the present invention readily receives and releases the snowboard to facilitate use of the device and allow the angular orientation of the held board with respect to the support surface to be readily varied to facilitate access to the held snowboard and create a more efficient storage means for the snowboards.

Recent years have seen a tremendous growth in the sport of snowboarding. Snowboards, like snow skies, must be stored when not in use. A wide variety of ski racks and holders have been developed for holding one or more pairs of snow skis against a wall or rail. Such a mounting typically positions the skis for easy access while efficiently storing the skis such that they occupy a minimal amount of space. Unfortunately, such racks and holders are generally not designed for use with snowboards which are much shorter and thinner than typical snow skis, and are substantially wider than a snow ski. As a result, snowboards are frequently left unsecured when not in use where they can be damaged or stolen and, when at home, occupy an inordinate amount of storage space.

In view of the incompatibility of snowboards and snow ski racks and holders, it would be highly desirable to provide a holding device particularly adapted for securing snowboards in place against a wall or rail or other raised supporting surface. It would also be desirable if such a device were adaptable for holding snowboards in variable planar orientations such that the board or boards could be held flush with the wall or rail, perpendicular thereto or at any desired angular orientation with respect thereto. Such a variable mounting would provide easy access to one or more boards stored against a wall, maximize board storage capacity in areas of limited wall space and minimize the intrusion of the stored snowboard or snowboards into the area adjacent the supporting wall for storage in narrow areas. It would also be desirable if the snowboard holding device projected only a minimal distance from the wall when not in use so as to be unobtrusive and not present a hazard to passersby. The holding device of the present invention obtains all of these results.

SUMMARY OF THE INVENTION

Briefly, the snowboard holder of the present invention comprises a base member adapted to be secured to a vertical wall, rail or other upstanding supporting surface and a clip member which is mounted on the base member for pivotal movement with respect thereto about both vertical and horizontal axes. The clip member defines a pair of laterally spaced flexible securement arms for gripping a transverse portion of the snowboard at a midway point between the front binding and top of the board and holding the board in a vertical orientation adjacent the wall or rail. The flexure in the arms of the clip member allows a snowboard to be readily inserted between the securement arms through the open ends thereof and held therebetween with the lower end of the snowboard resting on the floor or ground. The pivotal securement of the clip member to the base member about a vertical axis allows the snowboard to be oriented in a plane perpendicular to the surface of the supporting wall or rail, substantially flush therewith or at any angular orientation therebetween. By positioning the snowboard perpendicular to the wall or other supporting surface access to the snowboard is facilitated. By angling the plane of the board with respect to the wall, the number of snowboards which can be secured in close parallel proximity by a plurality of closely spaced holding devices is maximized over a given area of wall space. By pivoting the board and clip to a parallel disposition with respect to the wall, the flush mounting of the board against the wall minimizes the intrusion of the board into the area adjacent the wall, thus providing an ideal wall mounting for narrow hallways or other areas of limited access. Upon removal of the board from the holder, the pivotal securement of the clip member to the base member about a horizontal access allows the clip member to be oriented in a folded disposition, flush with the base member so it becomes unobtrusive and does not present a hazard to passersby.

It is the principal object of the present invention to provide a device particularly adapted for conveniently and efficiently holding snowboards against a wall or other suitable support surface with the tip or tail of the board resting on the floor or ground.

It is another object of the present invention to provide a wall mounted holding device for snowboards which holds the board in a vertical disposition and allows the board to be pivoted about a vertical axis such that the board can be stored at any desired angular orientation with respect to the wall for convenience and space savings.

It is still another object of the present invention to provide a wall mounted holding device for snowboards which is of simple construction and economical to manufacture.

It is yet another object of the present invention to provide a wall mounted holding device for snowboards which eliminates the safety hazard presented by protruding securement arms or hooks when the holding device is not in use.

It is a still further object of the present invention to provide a wall mounted holding device for snowboards which provides a message display surface upon which logos, shop names or other indicia can be readily displayed for promotional or other purposes.

These and other objects and advantages of the present invention will become readily apparent from the following detailed description taken in conjunction with the accompanying drawings.

DESCRIPTION OF THE PREFERRED EMBODIMENT

Figure 2:
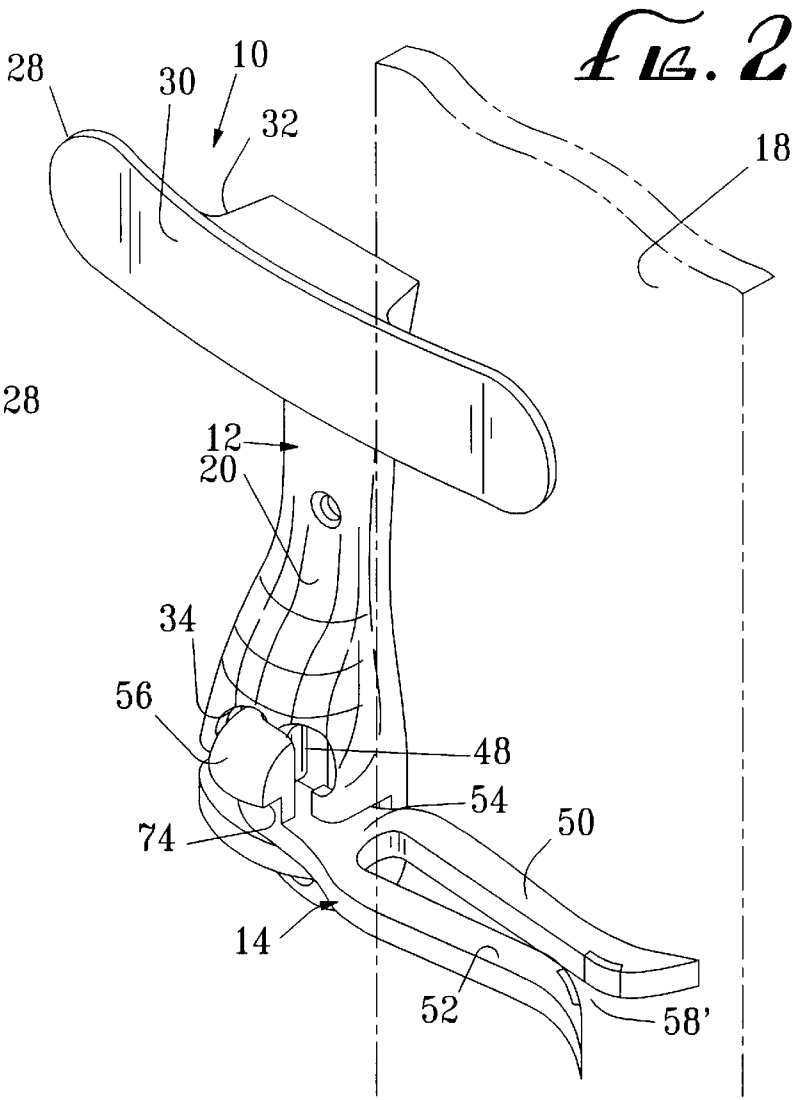
FIG. 2 is a perspective view of the snowboard holding device of the present invention showing the mounting of the snowboard in a flush disposition with respect to the mounting wall.

Referring now in detail to the drawings, the snowboard holding device 10 of the present invention is comprised of a base member 12 and a clip member 14 and is adapted to be mounted on a vertical wall or other suitable support structure such as a rail (not shown) for securing a snowboard 18 adjacent the wall or other support structure (hereinafter collectively referred to as a supporting wall). The base member 12 is preferably formed by injection molding of a durable plastic material and defines a stem portion 20 having apertures 22 and 24 extending therethrough which are adapted to receive a pair of threaded fastening members for securing the holding device 10 to the supporting wall. Aperture 22 is preferably positioned proximate the mid portion of stem 20 and aperture 24 is disposed adjacent the lower end 26 of stem portion 20. A message bar 28 defining a substantially flat forward-facing surface 30 is preferably provided at the upper end of stem portion 20 for displaying a manufacturers logo, shop name or other promotional message thereon. A projecting element 32 is preferably formed on the stem portion 20 for carrying the message bar 28 and offsetting the bar slightly from the stem portion 20 of the base member 12 for reasons to be discussed.

Figure 4:
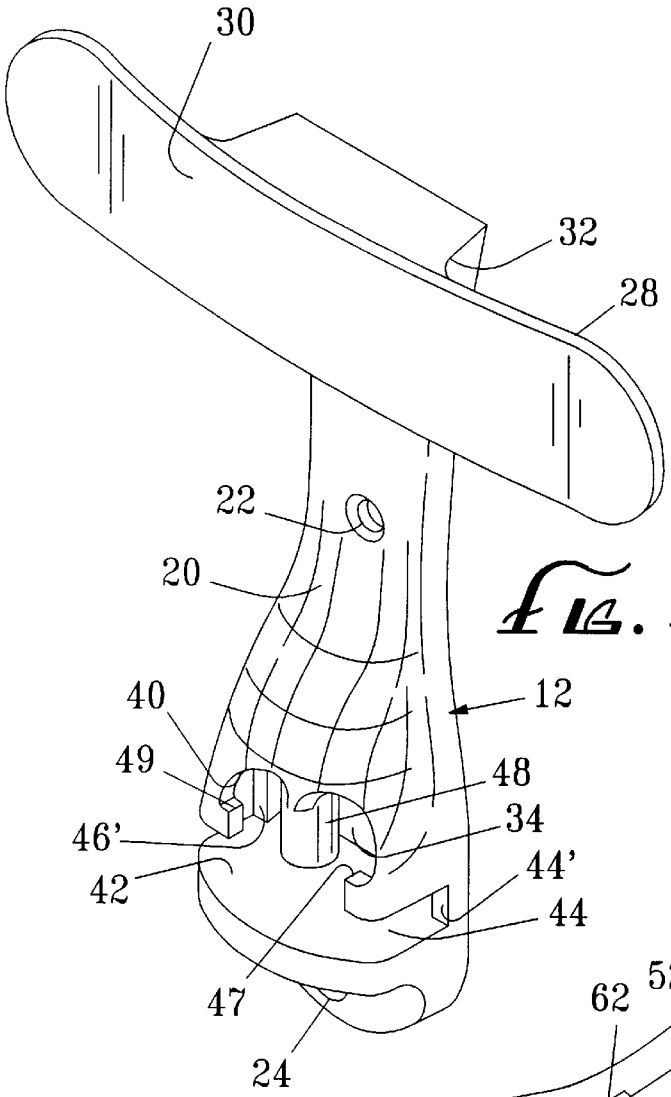
FIG. 4 is a perspective view of the base portion of the holding device of the present invention.

A cavity 34 is formed proximate the lower end 26 of stem portion 20 for receiving clip member 12. Stem portion 20 tapers forwardly below the upper mounting aperture 22 such that the lower end of the stem portion of the clip member is of an increased thickness. Cavity 34 is configured so as to define an upper curvilinear wall surface 40, a lower forwardly projecting flat wall surface 42 and parallel opposed slots 44 and 46 which terminate at their rearward ends in vertically extending walls 44' and 46'. A cylindrical pivot member 48 extends downwardly from curvilinear wall surface 40 into cavity 34 with the lower end of the pivot member 48 being upwardly spaced from the lower wall surface 42 as seen in FIG. 4. A pair of projections 47 and 49 are defined by the base member 12 which extend inwardly of cavity 34 from opposite lateral sides thereof for supporting the clip member 14 thereon as will be described.

Figure 5:
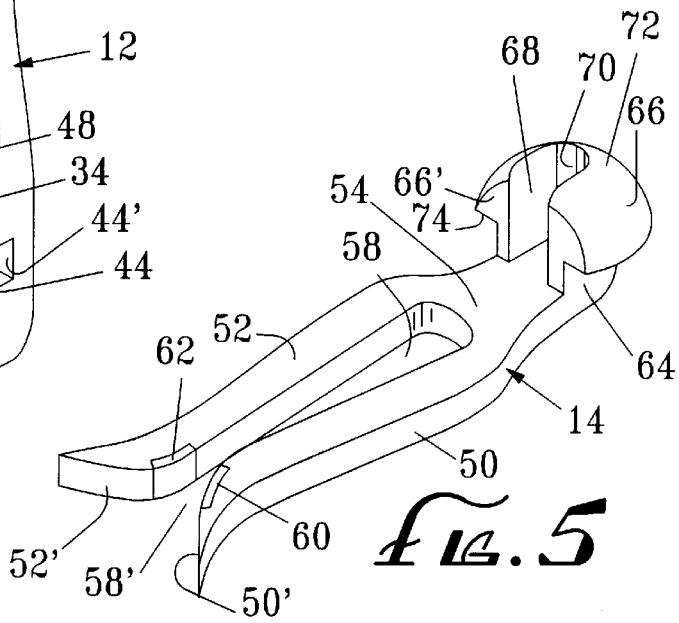
FIG. 5 is a perspective view of the clip portion of the holding device of the present invention.
Figure 6:
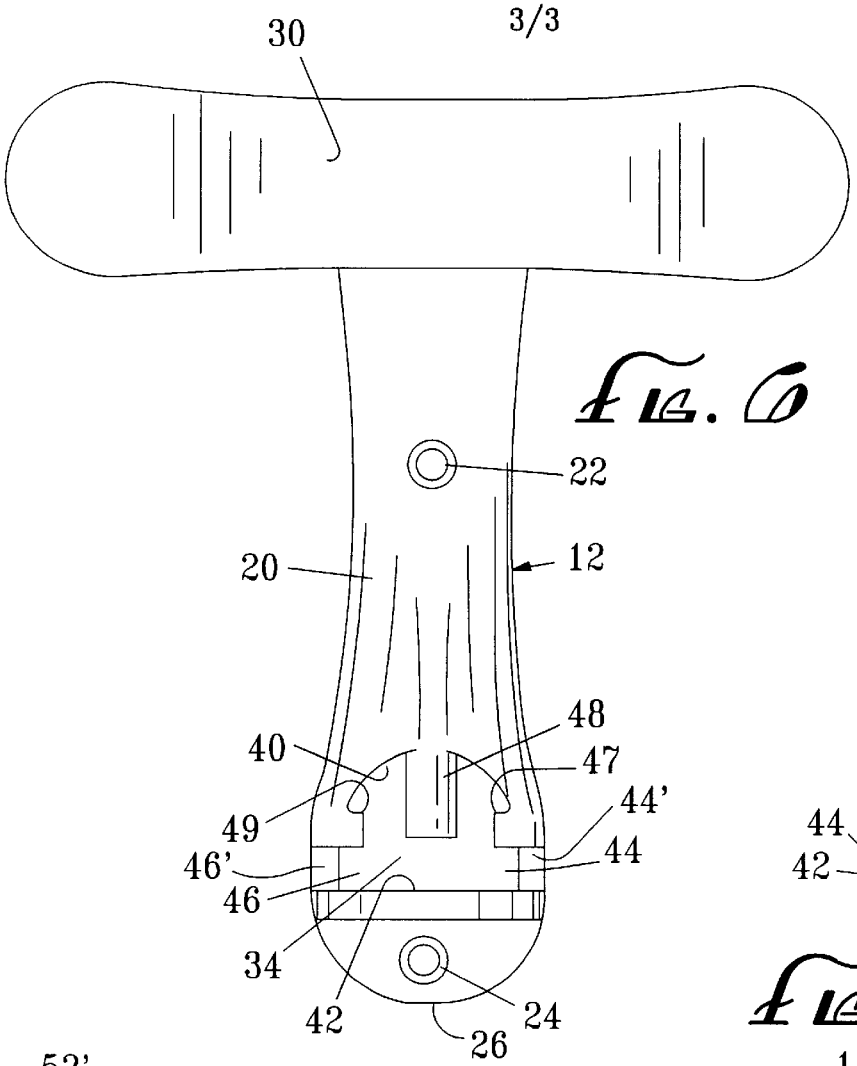
FIG. 6 is a front view of the base portion of the holder of the present invention.
Figure 7:
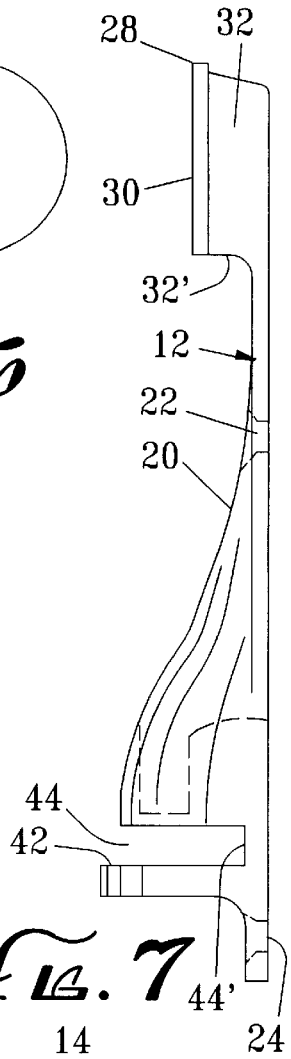
FIG. 7 is a side view of the base portion of the holder of the present invention.

The clip member 14 of holding device 10 (see FIG. 5) is also preferably formed by an injection molding process and defines a pair of outwardly projecting, laterally spaced flexible snowboard gripping arms 50 and 52 which are joined together at their rearward ends in a flat web portion 54. Clip member 14 also defines a raised rear body portion 56 adjacent web 54. The channel 58 formed between arms 50 and 52 of the clip member 14 is open at its forward end 58' to receive a transverse portion of a snowboard 18. The clip member 14, like the base member 12 is preferably of single-piece construction and can be molded of a plastic or other suitable material such that arms 50 and 52 thereon have a natural flexure for gripping snowboards of various thickness therebetween.

The gripping arms 50 and 52 of the snowboard holding device 10 are preferably inwardly tapered and define outwardly flared end portions 50' and 52' to facilitate the entry of a snowboard therebetween. A pair of rubber pads 60 and 62 can be secured to the inner surfaces of arms 50 and 52 rearwardly adjacent the flared end portions 50' and 52' to provide a more secure gripping of the snowboard. Alternatively, the clip member 14 can be injection molded from a material such as a thermoplastic rubber and nylon polymer composition so as to provide arms 50 and 52 with a high coefficient of friction for gripping the snowboard and obviating any need for the rubber pads 60 and 62.

Figure 8:
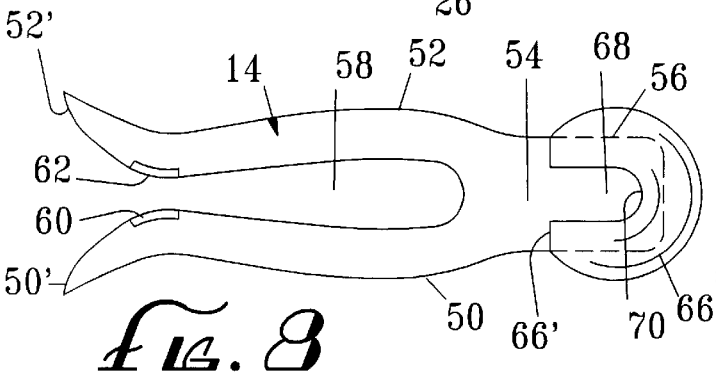
FIG. 8 is a top plan view of the clip portion of the holder of the present invention.
Figure 9:
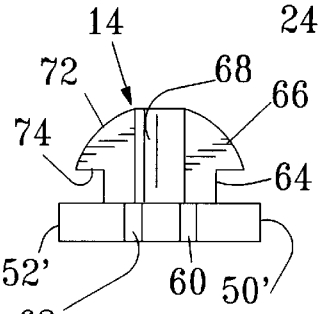
FIG. 9 is an end view of the clip portion of the holder of the present invention.
Figure 10:
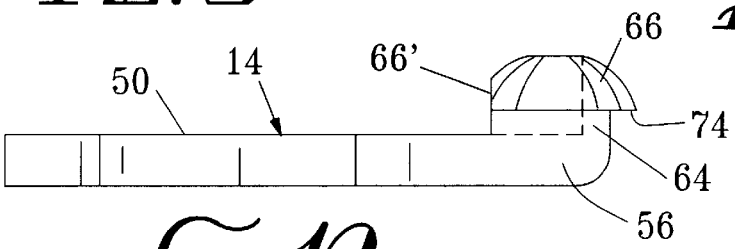
FIG. 10 is a side view of the clip portion of the holder of the present invention.

The body portion 56 of clip member 14 comprises an extension 64 terminating at its upper end in a button portion 66 which is truncated at its forward end 66' as seen in FIGS. 8 and 10. The extension 64 and button portion 66 of the clip member body define a slot 68 therein. Slot 68 is open at its forward end, defines a curvilinear wall portion 70 at its rearward end and is sized so as to receive the depending cylindrical pivot member 48 on base member 12. The button portion 66 of the clip member body defines a curvilinear upper surface 72 and is of a larger transverse dimension than extension 64 so as to define a flat wall surface 74 extending about the underside of the button portion 66.

To assemble the snowboard holding device, the clip member 14 is inserted forwardly through the cavity 34 in base member 12 from the rear side of the base member such that the pivot member 48 on base member 12 projects into the slot 68 on clip member 14 and the flat annular wall surface 74 extending about the underside of button portion 66 rests on the projections 47 and 49 projecting inwardly from the opposite sides of the cavity 34 in base member 12.

Figure 1:
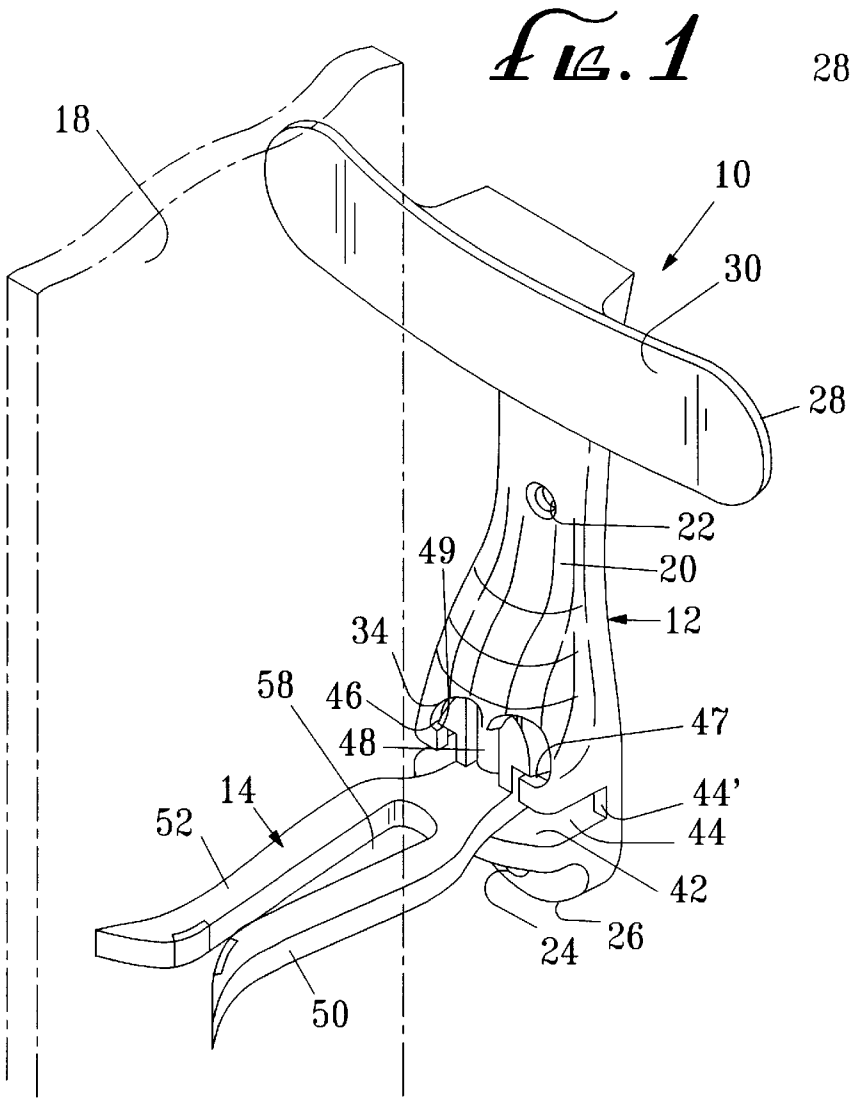
FIG. 1 is a perspective view of the snowboard holding device of the present invention showing the mounting of the snowboard in a perpendicular disposition with respect to the mounting wall.
Figure 3:
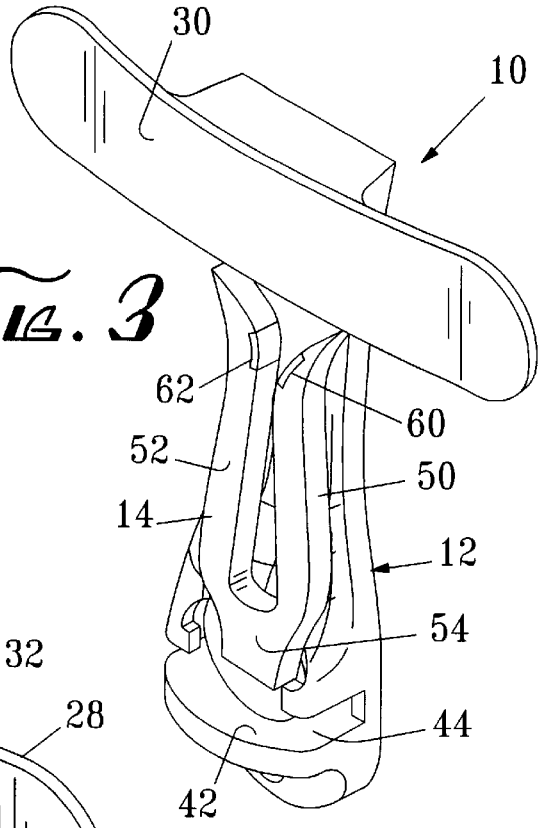
FIG. 3 is a perspective view of the snowboard holding device of the present invention shown in the folded disposition.

As a result of the above-described mating components of the clip member 14 with the base member 12, the clip member can be pivoted with respect to the base member about a horizontal axis from a forwardly projecting horizontal disposition as seen in FIG. 1 to a vertical disposition adjacent the base member as seen in FIG. 3. In the extended position of FIG. 1, the horizontally projecting clip member 14 is adapted to receive and hold a traverse portion of a snowboard 18 between arms 50 and 52. In the upwardly pivoted or folded disposition of FIG. 3, the clip member 14 of the snowboard holder 10 is flush with the base portion 12 so that when the snowboard holder 10 is not in use, the projecting securement arms will not present a safety hazard to passersby.

The length of the clip member 14 is sized so as to be slightly greater than the distance between the bottom wall surface 42 of cavity 34 and the underside 32' of the extension 32 which carries the message bar 28. As a result, in the folded position illustrated in FIG. 3, the rear end of the button portion 64 on clip member 14 bears against the lower wall 42 of the base member 12 and the extended ends 50' and 52' of gripping arms 50 and 52 bear against the underside 32' of extension 32, thereby releasably securing the clip member 14 in the folded position.

With securement arms of the clip member in the horizontal extended position, the snowboard holding device 10 can hold a snowboard 18 for storage in a vertical disposition in any desired angular orientation with respect to the supporting wall 16 to which the holding device 10 is secured. The snowboard 18 is held by the flexed gripping arms of the clip member pressing against a transverse portion of the snowboard with the tail or nose of the snowboard resting on the ground or floor. In this position the board can be stored perpendicular to the supporting wall 16 as seen in FIG. 1, in a substantially flush disposition with respect to the wall as seen in FIG. 2, or, by pivoting the clip member of the holding device about the cylindrical pivot member 48 on the base member, in any desired angular orientation therebetween. Thus, in narrow hallways or other areas where space adjacent the supporting wall is at a premium, the holding device 10 can be used to hold the snowboard in a flush orientation against a wall. For easy access to the board, the board can be stored in a perpendicular disposition to the supporting wall. The holding device 10 can be used with a plurality of other holding devices 10 to store a corresponding plurality of snowboards in an adjacent angular disposition with respect to the supporting wall thereby maximizing the number of snowboards which can be conveniently stored against a given amount of wall space. Thus, the pivotal mounting of holding device 10 facilitates both access to and storage of the snowboards and is ideally suited for conveniently storing a large number of boards in a minimal space.

Various changes and modifications may be made in carrying out the present invention without departing from the spirit and scope thereof. Insofar as these changes and modifications are within the purview of the appended claims, they are to be considered as part of the present invention.

I claim:

1. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to the supporting wall and said clip member defining a pair of laterally spaced flexible gripping arms for holding a transverse portion of the snowboard therebetween and cooperating with said base member to define a pivotal mounting of said clip member on said base member, said mounting allowing a first movement of said clip member about a horizontal axis whereby said arms can be moved between a snowboard holding position wherein said arms project outwardly from said base member for receiving and holding the snowboard and a folded position wherein said arms are disposed parallel to and adjacent said base member and, upon said arms being disposed in said holding position, said mounting allowing a second movement of said clip member about a vertical axis whereby upon inserting the transverse portion of the snowboard between said arms, said arms and the snowboard can be moved between perpendicular and parallel orientations with respect to said supporting wall, and wherein said base member defines a cavity therein and includes a pivot member projecting into said cavity and wherein said clip member defines a body portion proximate said gripping arms, said body portion defining a slot therein and being disposed in said cavity in said base member such that said pivot member projects into said slot whereby said clip member can be moved about said horizontal and vertical axes.

2. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to the supporting wall and said clip member defining a pair of laterally spaced flexible gripping arms for holding a transverse portion of the snowboard therebetween and cooperatinz with said base member to define a pivotal mounting of said clip member on said base member, said mounting allowing a first movement of said clip member about a horizontal axis whereby said arms can be moved between a snowboard holding position wherein said arms project outwardly from said base member for receiving and holding the snowboard and a folded position wherein said arms are disposed parallel to and adjacent said base member and, upon said arms being disposed in said holding position, said mounting allowing a second movement of said clip member about a vertical axis whereby upon inserting the transverse portion of the snowboard between said arms, said arms and the snowboard can be moved between perpendicular and parallel orientations with respect to said supporting wall, and wherein said pivotal mounting is disposed proximate a first end of said base member and including a clip retention element carried by said base member proximate a second end of said base member, said clip retention element extending outwardly from said base member and engaging said clip member upon said clip member being moved to said folded position, whereupon said element retains said clip member in said folded position.

3. The snowboard holding device of claim 2 wherein said clip retention element is spaced from said mounting on said base member a predetermined distance whereby upon said clip member being moved to said folded position, said clip retention element engages extended end portions of said gripping arms, and including a message board carried by said retention element.

4. A device adapted to be mounted on a supporting wall for holding a snowboard in a vertical disposition adjacent the wall and allowing pivotal movement of the snowboard relative to the wall to facilitate access to and storage of the snowboard, said device comprising a base member and a clip member, said base member being adapted to be secured to the supporting wall, said clip member defining a web portion, a pair of parallel laterally spaced flexible gripping arms projecting from said web portion for holding a transverse portion of the snowboard therebetween and a body portion disposed rearwardly adjacent said web portion, said body portion being disposed within and cooperating with said base member to define a pivotal mounting of said clip member on said base member whereby said clip member can be moved between a snowboard holding position wherein said gripping arms project outwardly from said base member for receiving and holding the snowboard and a folded position wherein said arms are disposed parallel to and adjacent said base member and, upon said arms being disposed in said holding position, said mounting allowing a second movement of said clip member about a vertical axis whereby, upon inserting the transverse portion of the snowboard between said arms, said arms and the snowboard can be moved between perpendicular and parallel orientations with respect to said supporting wall, and wherein said base member defines a cavity therein and a pivot member projecting into said cavity and said body portion on said clip member defines a slot therein, said body portion being disposed in said cavity in said base member such that said pivot member projects into said slot whereby said clip member can be moved about said horizontal and vertical axes.

5. A device adapted to be mounted on a supporting wall for holding a snowboard in a vertical disposition adjacent the wall and allowing pivotal movement of the snowboard relative to the wall to facilitate access to and storage of the snowboard, said device comprising a base member and a clip member, said base member being adapted to be secured to the supporting wall, said clip member defining a web portion, a pair of parallel laterally spaced flexible gripping arms projecting from said web portion for holding a transverse portion of the snowboard therebetween and a body portion disposed rearwardly adjacent said web portion, said body portion being disposed within and cooperating with said base member to define a pivotal mounting of said clip member on said base member whereby said clip member can be moved between a snowboard holding position wherein said gripping arms project outwardly from said base member for receiving and holding the snowboard and a folded position wherein said arms are disposed parallel to and adjacent said base member and, upon said arms being disposed in said holding position, said mounting allowing a second movement of said clip member about a vertical axis whereby, upon inserting the transverse portion of the snowboard between said arms, said arms and the snowboard can be moved between perpendicular and parallel orientations with respect to said supporting wall, and including a clip retention member carried by and projecting from said base member, said retention member engaging extended end portions of said gripping arms upon said clip member being moved to said folded position and releasably retaining said clip member in said folded position.

6. The snowboard holding device of claim 5 including a message bar carried by said clip retention member.

7. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to the supporting wall and defining a cavity therein, a horizontal clip member support surface within said cavity and a pivot member projecting into said cavity, said clip member defining a pair of laterally spaced securement arms for holding a transverse portion of the snowboard therebetween and a body portion rearwardly spaced from said securement arms, said body portion having an open ended slot therein and having a downwardly facing surface carried by said support surface within said cavity in said base member and said pivot member on said base member extending into said slot in said body portion of said clip member whereby said clip member is carried by said base member and moveable with respect thereto about a horizontal axis and about a vertical axis whereby said securement arms can be moved between an extended snowboard support position wherein said securement arms project outwardly from said base member for receiving and holding the snowboard and a folded position wherein said arms are disposed adjacent said base member and, upon said securement arms being disposed in said extended support position, said securement arms can be oriented perpendicularly with respect to the supporting wall, parallel to the supporting wall and at any desired angular orientation therebetween.

8. The snowboard holding device of claim 7 wherein said clip member defines a web portion disposed between said body portion and said securement arms, said arms projecting outwardly from said web portion and being flexible with respect thereto for holding snowboards of varying thicknesses therebetween.

9. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to the supporting wall and defining a cavity therein, a clip member support surface within said cavity and a pivot member projecting into said cavity, said clip member defining a pair of laterally spaced securement arms for holding a transverse portion of the snowboard therebetween and a body portion rearwardly spaced from said securement arms, said body portion having an open ended slot therein and being carried by said support surface within said cavity in said base member and said pivot member on said base member extending into said slot in said body portion of said clip member whereby said clip member is carried by said base member and moveable with respect thereto about a horizontal axis and about a vertical axis whereby said securement arms can be moved between an extended snowboard support position wherein said securement arms project outwardly from said base member for receiving and holding the snowboard and a folded position wherein said arms are disposed adjacent said base member and, upon said securement arms being disposed in said extended support position, said securement arms can be oriented perpendicularly with respect to the supporting wall, parallel to the supporting wall and at any desired angular orientation therebetween, and including a clip retention element projecting outwardly from said base member, said element engaging said clip member upon said clip member being moved to said folded position and releasably retaining said clip member in said folded position.

10. The snowboard holding device of claim 9 including a message bar carried by said retention element and extending transversely of said base member.

11. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to a supporting wall and said clip member defining a pair of laterally spaced flexible gripping arms for holding a transverse portion of the snowboard therebetween and cooperating with said base member to define a pivotal mounting of said clip member on said base member, said pivotal mounting including a cavity in said base member with a pivot member projecting into said cavity and a slot in said clip member engaged by said pivot member with said clip member having a body portion mating with said cavity for allowing movement of said clip member about a horizontal axis whereby said arms can be moved between a snowboard holding position wherein said arms project outwardly from said base member for receiving and holding the snowboard and a folded position wherein said arms are disposed parallel to and adjacent said base member.

12. A device adapted to be mounted on a supporting wall for holding a snowboard in a substantially vertical disposition adjacent the wall and allowing pivotal movement of the snowboard relative to the wall to facilitate access to and storage of the snowboard, said device comprising a base member and a clip member, said base member being adapted to be secured to a supporting wall and said clip member defining a pair of laterally spaced flexible gripping arms for holding a transverse portion of the snowboard therebetween and cooperating with said base member to define a pivotal mounting of said clip member on said base member, said pivotal mounting including a cavity in said base member with a pivot member projecting into said cavity and a slot in said clip member engaged by said pivot member with said clip member having a body portion mating with said cavity for allowing movement of said clip member about a vertical axis whereby upon inserting the transverse portion of the snowboard between said arms, said arms and the snowboard can be moved between perpendicular and parallel orientations with respect to said supporting wall.

* * * * *